US009848467B2

(12) United States Patent
Li et al.

(10) Patent No.: US 9,848,467 B2
(45) Date of Patent: Dec. 19, 2017

(54) DRIVER FOR DRIVING A LOAD

(71) Applicant: PHILIPS LIGHTING HOLDING B.V., Eindhoven (NL)

(72) Inventors: Duo L. Li, Eindhoven (NL); Dennis Johannes Antonius Claessens, Eindhoven (NL); Hui Zhang, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/314,809

(22) PCT Filed: May 18, 2015

(86) PCT No.: PCT/EP2015/060884
§ 371 (c)(1),
(2) Date: Nov. 29, 2016

(87) PCT Pub. No.: WO2015/180989
PCT Pub. Date: Dec. 3, 2015

(65) Prior Publication Data

US 2017/0196056 A1 Jul. 6, 2017

(30) Foreign Application Priority Data

May 30, 2014 (WO) ..... PCT/CN2014/078982
Oct. 3, 2014 (EP) ..... 14187630

(51) Int. Cl.
*H05B 33/08* (2006.01)

(52) U.S. Cl.
CPC ..... *H05B 33/0815* (2013.01); *H05B 33/0842* (2013.01); *H05B 33/0887* (2013.01)

(58) Field of Classification Search
None
See application file for complete search history.

(56) References Cited

U.S. PATENT DOCUMENTS 8,581,514 B2 * 11/2013 Ruan ..... H05B 33/0809 315/294
9,444,358 B2 * 9/2016 Kwasinski ..... H02M 3/33569
(Continued)

FOREIGN PATENT DOCUMENTS

CN 103199677 A 7/2013

OTHER PUBLICATIONS

M.F.A. Emadi, et al., "Suitability of Pulse Train (tm), a Novel Digitally Implemented Real-Time Control Technique, for BIFRED Converter", IEICE/IEEE INTELEC'03, Oct. 19-23, 200-13, pp. 542-548.

(Continued)

*Primary Examiner* — Crystal L Hammond
(74) *Attorney, Agent, or Firm* — Akarsh P. Belagodu

(57) ABSTRACT

Driver (1) for driving a load (L), the driver having BiFRED topology and comprising: —a first input terminal (5) and a second input terminal (6); a pair of output terminals (9*a*, 9*b*) for connecting the load; —a Bi FRED converter coupled to the input terminals, comprising: —a first inductor (L1), coupled to a first input terminal (5); —a first capacitor (C1) in series connection with the first inductor; —a controllable switch (S1) between the interconnection of the first inductor and the first capacitor and the second input terminal (6); —a second inductor (L2) coupled between the first capacitor and the second input terminal; —a control device (20; 30)for controlling the controllable switch (S1); wherein said control device (20; 30) comprises: —a first sensing element (21) for sensing the current through said switch (S1) and providing a first output signal proportional to said current, said current being the sum of the charging current of the first inductor (L1) and discharging current of the first capacitor (C1); —a reference device (24) for providing a reference signal; —comparing element for comparing said first output (Continued)

signal with said reference signal, and for switching said switch to a non-conductive state in each transition of the controllable switch's oscillation when said first output signal is equal to or higher than said reference signal; —an output capacitor (C2) connected between said output terminals (9*a*, 9*b*); —a second diode (D2) connected in series with said output capacitor (C2); —a second sensing element (25) for sensing the current through said second diode (D2), and for providing a second output signal for switching said switch to a conductive state when said current through said second diode (D2) reaches zero; wherein said second sensing element (25) comprises a sensing inductor (25) inductively coupled to said second inductor (L2) wherein the sensing inductor (25) having one end connected to the second input terminal (6) and having its opposite end coupled to the control terminal of the controllable switch (S1).

14 Claims, 5 Drawing Sheets

(56) References Cited

U.S. PATENT DOCUMENTS 9,497,814 B2 * 11/2016 Elferich ..... H05B 33/0815
9,544,962 B2 * 1/2017 Elferich ..... H05B 33/0803
9,641,090 B2 * 5/2017 Kwasinski ..... H02M 3/33569
2002/0154521 A1 10/2002 Francescutti et al.
2005/0168199 A1 8/2005 Claessens et al.
2013/0193879 A1 8/2013 Sadwick et al.

OTHER PUBLICATIONS

V. Toumainen, et al., "Simulation Results of a Current Mode Controlled BIFRED", EPE—European Power Electronics and Drives Association, Apr. 15, 2014, 2 pages.
YS Lai, et al., "A Family of Predictive Digital-Controlled PFC Under Boundary Current Mode Control", Center for Power Electronics Technology, National Taipei University of Technology, 2009, pp. 1-10.
M. Madigan, et al., "Integrated High Quality Rectifier-Regulators", 1999 IEEE Power Electronics Specialists Conference, 9 pages.
J. Qian, et al., "Advanced Single-Stage Power Factor Correction Techniques", Virginia Polytechnic Institute and State University, Blacksburg, Virginia, Sep. 25, 1977, 185 pages.
K. Rezaei, "A Control Scheme for an AC-DC Single-Stage Buck-Boost PFC Converter with Improved Output Ripple Reduction", The School of Graduate and Postdoctoral Studies, The University of Western Ontario, London, Ontario, Canada, 2012, 90 pages.
H. Yilmaz, "Design, Application and Comparison of Single Stage Flyback and Sepic PFC AC/DC Converters for Power LED Lighting Applicaiton", The Graduate School of Natural Applied Sciences of Middle East Technical University, Sep. 2013, 217 pages.

* cited by examiner

DRIVER FOR DRIVING A LOAD

CROSS-REFERENCE TO PRIOR APPLICATIONS

This application is the U.S. National Phase application under 35 U.S.C. §371 of International Application No. PCT/EP2015/060884, filed on May 18, 2015, which claims the benefit of European Patent Application No. 14187630.0, filed on Oct. 3, 2014, and Chinese Patent Application No. PCT/CN2014/078982, filed on May 30, 2014. These applications are hereby incorporated by reference herein.

FIELD OF THE INVENTION

The present invention relates in general to the field of lighting, particularly LED lighting. The present invention relates more particularly to a driver for an LED lamp, although the driver can also be used for other types of load.

BACKGROUND OF THE INVENTION

LED lighting technology is developing rapidly. Especially, LEDs become available at decreasing prices. For use in LED lighting appliances, there is a general desire to provide low-cost LED drivers. Reducing the costs can for instance be done by reducing the number of components, and single-stage driver architectures are preferred. On the other hand, with increasing LED power, the drivers must meet more stringent requirements relating to distortion of the line current. Although low line current distortion is feasible with single stage architectures, there often is a trade-off between load regulation and line regulation, line-current-distortion and output ripple (flicker) and the corresponding buffer size and cost.

A well-known single-stage driver topology is the BiFRED topology (Boost Integrated Flyback Rectifier/Energy storage DC/DC converter).

FIG. 1A is a block diagram schematically showing a BiFRED converter 1 powered from mains 2 for driving an LED load L. Reference numeral 3 indicates a rectifier, reference numeral 4 indicates an EMI filter. The actual converter comprises a series arrangement of a first diode D1, a first inductor L1, a storage capacitor C1 and a second inductor L2 connected between first and second input terminals 5 and 6. The input terminals 5 and 6 are connected to the output of the filter 4.

It is noted that the order of first diode D1 and first inductor L1 may be different. It is further noted that the order of storage capacitor C1 and second inductor L2 may be different. It is further noted that the direction of the first diode D1 determines the direction of current flow, and hence determines the mutual polarity of the input terminals. For sake of convenience, first input terminal 5 will be termed "high" input terminal while second input terminal 6 will be termed "low" input terminal.

Reference numeral A indicates a node between first inductor L1 and the series arrangement of storage capacitor C1 and second inductor L2. A controllable switch S1 is connected between the node A and the low input terminal 6.

The converter 1 further comprises, connected in parallel to the second inductor L2, a series arrangement of a second diode D2 and a parallel arrangement of an output capacitor C2 and the LED load L. Reference numerals 9*a* and 9*b* indicate output terminals for connecting the load. It is noted that the converter can also be used for other types of load.

Reference numeral 8 indicates a control device for the switch S1. The control device controls the switch S1 to be either conductive (first state) or non-conductive (second state), and alternates between these two states at a certain repetition frequency.

The basic operation is as follows. During the first state, the switch is conductive and the first inductor L1 is charged from rectified mains via the switch S1. The energy in the first inductor L1 is magnetic energy which is proportional to the inductor current. The inductor current is increasing.

During the second stage, the switch is un-conductive, the inductor current continues to flow, discharging the first inductor L1 and charging the storage capacitor C1. The current in the first inductor L1 decreases, while the voltage over the storage capacitor C1 increases. The charging current from L1 to C1 also flows partly through the second inductor L2 and partly via the second diode D2 to power the LED and to charge the output capacitor C2.

During the first stage, the storage capacitor C1 also discharges over the second inductor L2, via the switch S1. During the second stage, the energy stored in the second inductor L2 will be used to charge output capacitor C2 and to power the LED.

FIG. 1B is a schematic diagram showing an alternative embodiment of the converter, indicated by reference numeral 11. In this alternative embodiment, the second inductor L2 is the primary winding of a transformer T1 which has a secondary winding L3 connected to the second diode D2. An advantage of using such transformer is that the primary and secundary windings may be mutually isolated such as to provide an insulation between input and output, and the respective numbers of turns may have a ratio higher than 1 such as to provide in a voltage increase at the output, but otherwise the operation is the same as described above.

For a correct operation of the converter, the timing of the switching moments from first state to second state and from second state to first state is important. The control device may operate at an arbitrary high frequency, but in view of the fact that the charging current is derived from rectified mains, the current in the load may have a frequency component (ripple) equal to twice the mains frequency. Typically, the mains frequency is for instance 50 Hz (Europe) or 60 Hz (USA), and consequently the LED light output may have a ripple frequency of 100 or 120 Hz. This is observable, and therefore it is desirable that the magnitude of the ripple current is as low as possible.

Further, the power drawn from the mains must be proportional to the power consumed by the load L, and this is achieved by adapting the duty cycle of the switching control, wherein an increase in the relative duration of the first state corresponds to an increase in power.

A typical approach in Prior Art Single-Stage PFC LED Drivers is to place the buffering, or 100 Hz/120 Hz flicker filtering, at the output of the DC/DC converter because placing significant buffering at the input of the converter would depreciate the power-factor and increase the line current distortion. The output buffer typically consists of a large output capacitor C2 which forms a time constant with the dynamic resistance of the LEDs. To improve LED efficacy, LED manufacturers have consistently reduced the dynamic resistance of LEDs over the last decade, which has caused output buffer size and cost to increase significantly.

SUMMARY OF THE INVENTION

The present invention aims to provide a new design of the switch control device 8 that can be built with a low number of relatively simple components and therefore has low costs, while at the same time adequately and reliably providing the functions of output current ripple reduction, output current regulation, line current regulation, and line current shaping to reduce line current distortion, and also providing a high power factor.

In one aspect, the present invention provides a driver for driving a load, the driver having BiFRED topology and comprising:

a first input terminal and a second input terminal;

a pair of output terminals for connecting the load;

a BiFRED converter coupled to the input terminals, comprising a first inductor, coupled to a first input terminal;

a first capacitor in series connection with the first inductor;

a controllable switch between the interconnection of the first inductor and the first capacitor and the second input terminal;

a second inductor coupled between the first capacitor and the second input terminal;

a control device for controlling the controllable switch; wherein said control device comprises:

a first sensing element for sensing the current through said switch and providing a first output signal proportional to said current, said current being the sum of the charging current of the first inductor and discharging current of the first capacitor;

a reference device for providing a reference signal;

comparing element for comparing said first output signal with said reference signal, and for switching said switch to a non-conductive state in each transition of the controllable switch's oscillation when said first output signal is equal to or higher than said reference signal.

An advantage of this aspect is the output current ripple is greatly reduced.

In a preferred embodiment, the BiFRED converter comprises:

a first series arrangement of a first diode and the first inductor, the first series arrangement having one end connected to the first input terminal and having an opposite second end connected to a first node;

a second series arrangement of the first capacitor and the second inductor, the second series arrangement having one end connected to the second input terminal and having an opposite second end connected to the first node;

the controllable switch connected between the first node and the second input terminal, wherein when the switch is conductive the first inductor is charged by the input terminals and the first capacitor discharges to charge the second inductor, and when the switch is non-conductive the first inductor discharges to charge the first capacitor, and said switch is adapted to oscillate for converting power;

an output capacitor connected between said output terminals;

a second diode connected in series with said output capacitor; wherein the series arrangement of second diode and output capacitor is connected in parallel with said second inductor, or in parallel with a third inductor inductively coupled to said second inductor;

and said control device further comprises:

a second sensing element for sensing the current through said second diode, and for providing a second output signal for switching said switch to a conductive state when said current through said second diode reaches zero.

A driver of this design has the advantages of including a relatively simple and low-cost control circuit that provides high performance without needing an additional isolated feedback loop, and that guarantees that the output portion of this circuit is always working in boundary conduction mode.

In a preferred embodiment, said first inductor has an inductivity selected such that, in the non-conductive state of said switch, the current in said first inductor reaches zero before the second sensing element switches said switch to the conductive state. This guarantees that the input portion of this circuit is always working in discontinuous mode.

In a particular embodiment, said second sensing element comprises a sensing inductor inductively coupled to said second inductor. This provides a simple and low-cost manner of implementing the second sensing element.

In a particular embodiment, said first sensing element comprises a sensing resistor connected between the switch and the second input terminal. This provides a simple and low-cost manner of implementing the first sensing element.

In a preferred embodiment, the switch comprises a transistor or a FET, having a first current path terminal coupled to said node, having a second current path terminal coupled to the second input terminal via a sensing resistor, and having a control terminal. This provides a simple and low-cost manner of implementing the switch.

Further advantageous elaborations are mentioned in the dependent claims.

It is noted that document US2002/0154521 discloses an insulated BiFRED converter comprising a measuring resistor RS in series with the controllable switch S1, such that the charging current of the first inductor L1 and the discharging current of the storage capacitor C1 pass through this measuring resistor RS and the sum current develops a measuring voltage over the measuring resistor RS, which measuring voltage is used as a control input signal for the control device ST. However, the document is silent on how to process this control input signal for providing the actual control output signal for the controllable switch S1. And US 20050168199A1 discloses a cuk type converter with a sensing resistor.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1A:
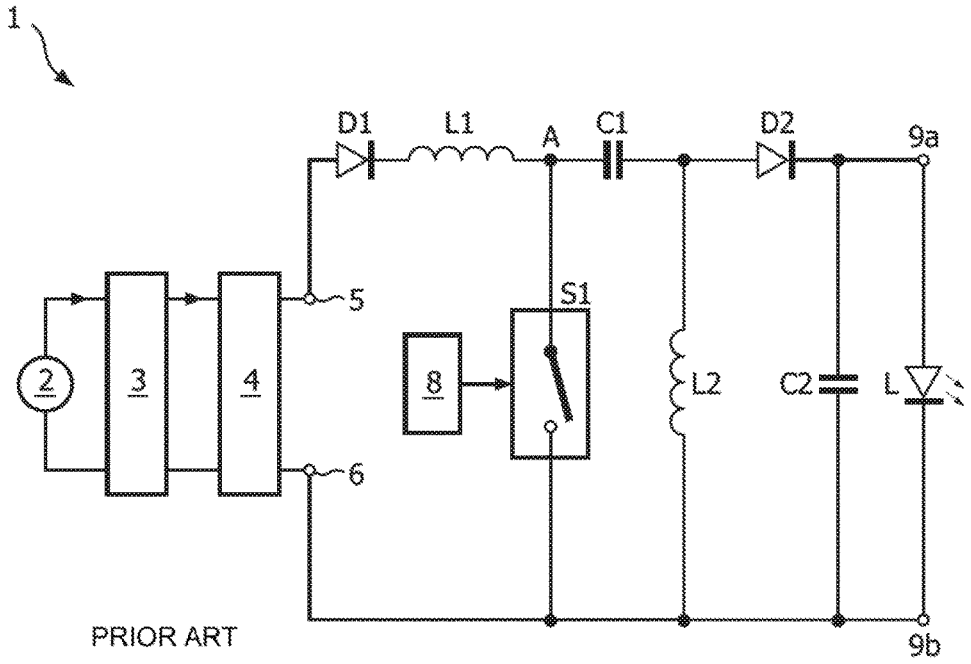
PRIOR ART FIG. 1A
FIG. 1A is a block diagram schematically showing a non-insulated BiFRED converter according to prior art.
Figure 1B:
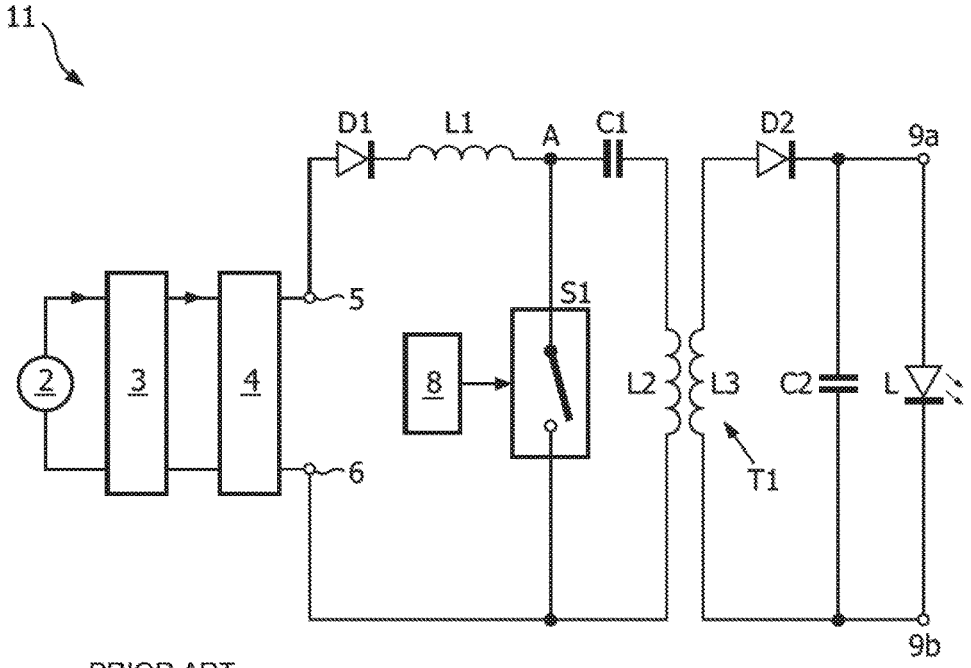
PRIOR ART FIG. 1B
FIG. 1B is a block diagram schematically showing an insulated BiFRED converter according to prior art.
Figure 2:
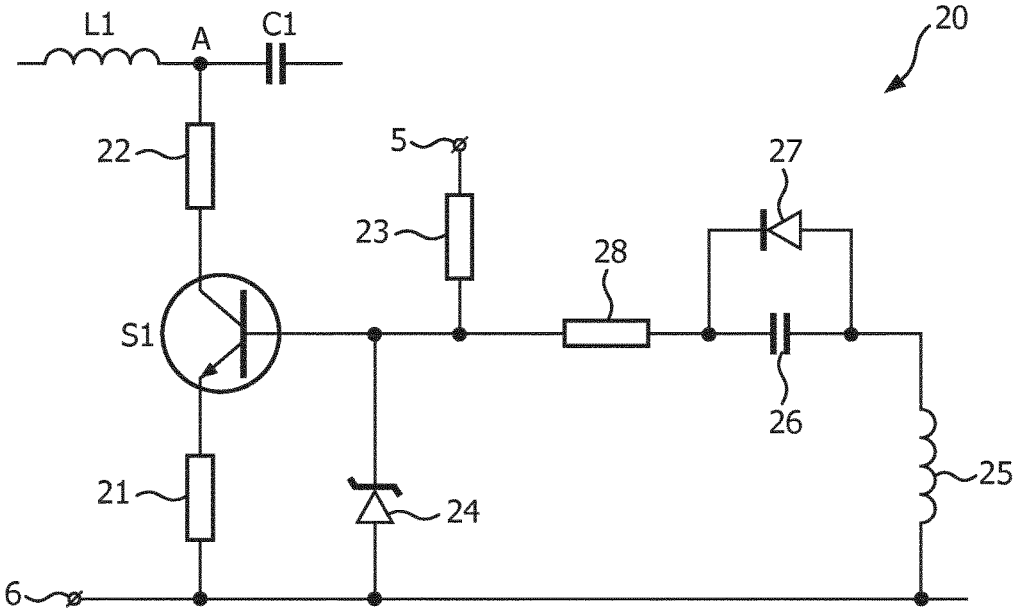
FIG. 2 schematically shows a circuit diagram of an exemplary switch control device according to the present invention.

FIG. 2 schematically shows a circuit diagram of a switch control device 20 according to the present invention. This inventive switch control device can be used in any of the converters of FIGS. 1A and 1B. In the exemplary embodiment shown, the switch S1 is implemented as a bipolar transistor, but alternative implementations are also possible, for instance a MOSFET. A sensing resistor 21 is connected in the switched current path between the emitter terminal of switch S1 and the low input terminal 6. The collector terminal of switch S1 is connected to node A via a second resistor 22, but this is not essential and this resistor may also be omitted. A bias resistor 23 connects the base terminal of switch S1 to the high input terminal 5. A voltage limiter 24, here embodied as a zener diode, is connected between the base terminal of switch S1 and the low input terminal 6.

Further, between the base terminal of switch S1 and the low input terminal 6, a series arrangement is connected of a fourth resistor 28, an auxiliary capacitor 26 and a feedback inductor 25. A third diode 27 is connected in parallel to the auxiliary capacitor 26, having its cathode directed towards the base terminal of switch S1. The feedback inductor 25 is magnetically coupled to the second inductor L2, having the same direction as the second inductor L2, so an increasing current in second inductor L2 will cause an increasing voltage induced over feedback inductor 25.

The operation is as follows.

Initially, on power up, the auxiliary capacitor 26 is empty, so the voltage at the base terminal of switch S1 is zero and the switch S1 is non-conductive. The auxiliary capacitor 26 will receive a small charging current via the bias resistor 23, causing the voltage at the base terminal of switch S1 to rise. When this voltage reaches the base-emitter threshold voltage, the switch S1 will start to become conductive. As described above, the storage capacitor C1 will discharge over the second inductor L2, which causes a positive voltage to be induced over the feedback inductor 25. This positive voltage is fed to the base terminal of switch S1 to accelerate the transition to its conductive state. The third diode 27 parallel to the auxiliary capacitor 26 allows for extra base current to be provided, via a current path that bypasses the impedance of the auxiliary capacitor 26.

With the switch S1 in its conductive state, the charging current of the first inductor L1 and the discharging current of the storage capacitor C1 together flow through the sensing resistor 21, causing the voltage drop over the sensing resistor 21 and hence the voltage at the emitter terminal of switch S1 to rise. Consequently, the voltage level at the base terminal of switch S1 rises (being the emitter voltage plus the forward voltage Vbe between base and emitter). On the other hand, the voltage level at the base terminal of switch S1 is limited by the Zener diode 24. When the voltage level at the base terminal of switch S1 reaches the breakdown voltage of the Zener diode, the base voltage of switch S1 can rise no further, and the rising emitter voltage will cause the switch S1 to make a transition to its non-conductive state.

In this non-conductive state of switch S1, the first inductor L1 is discharged to charge the storage capacitor C1, and the second inductor L2 is discharged to charge the output capacitor C2 and power the load L, as described above. The voltage over the feedback inductor 25 is now negative, keeping the switch S1 in its non-conductive state. With the discharging of the second inductor L2, the magnitude of the current in the second diode D2 reduces. When this magnitude becomes zero, the voltage across the feedback inductor 25 will become positive, causing a positive voltage at the base of switch S1 and hence turning the switch S1 to its conductive state. The above switching cycle repeats itself.

It will thus be seen that the converter is self-oscillating. The minimal current in the feedback inductor 25 is zero Amp, hence the converter operates in the Critical Discontinuous Mode.

Thus the timing of the switching cycle is based on two mechanisms. A first mechanism controls when the switch S1 is made conductive: this is the Critical Discontinuous Mode. A second mechanism controls when the switch S1 is made non-coductive: this mechanism is based on maximizing the summation of the charging current of the first inductor L1 and the discharging current of the storage capacitor C1, i.e. the peak-value of this summation is always constant. These two control mechanims in combination ensure a constant output current irrespective of input voltage and output voltage without any additional control-loop for output-current control being needed.

Figure 3:
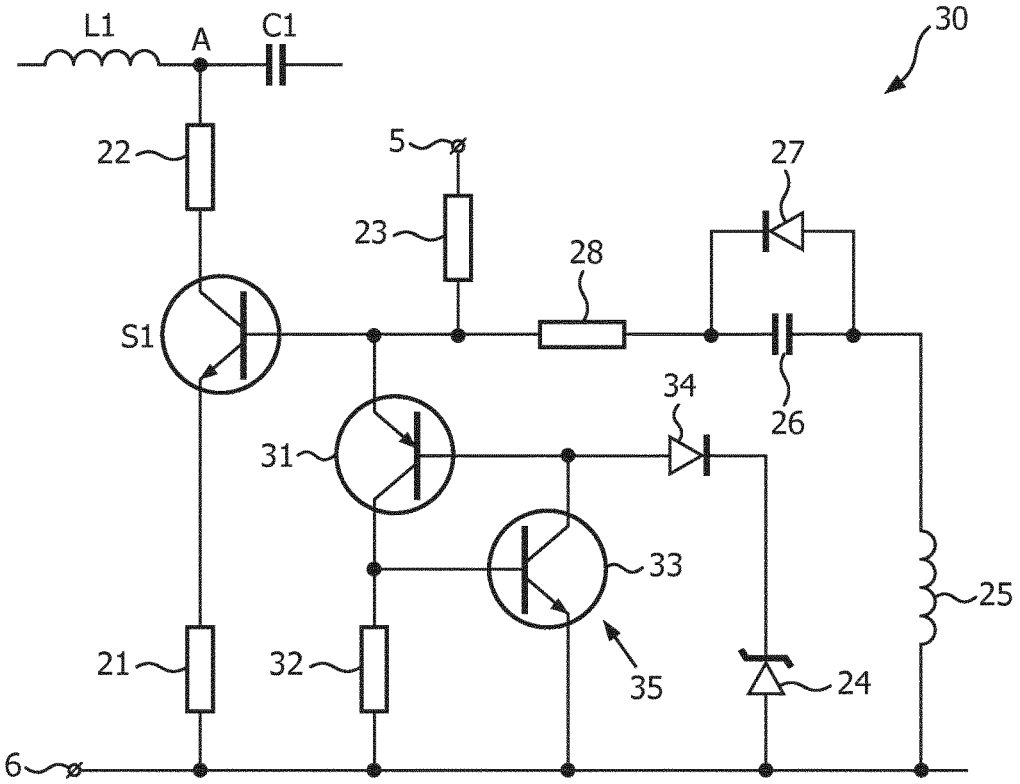
FIG. 3 schematically shows a circuit diagram of another exemplary switch control device according to the present invention.

FIG. 3 is a diagram comparable to FIG. 2, showing a switch control device 30 that is a further elaboration of the switch control device 20 of FIG. 2. Instead of the Zener diode 24 being connected directly to the base terminal of switch S1, a switching accelerator circuit 35 is connected between the Zener diode 24 and the base terminal of switch S1, which switching accelerator circuit 35 comprises a diode 34 having its cathode connected to the cathode of the Zener diode 24 and having its anode connected to the base terminal of a first transistor 31. The first transistor 31 has its emitter terminal connected to the base terminal of switch S1, and has its collector terminal connected to the low input terminal 6 via a fifth resistor 32. A second transistor 33 has its base terminal connected to the collector terminal of the first transistor 31, has its collector terminal connected to the base terminal of the first transistor 31, and has its emitter terminal connected to the low input terminal 6. The circuit 35 is to detect the breakdown current in the zener 24 as an indicator that the switch current is going to be zero, and operates to make the switch current zero as quickly as possible.

In the conductive state of the switch S1, with the increasing current through sensing resistor 21, the emitter voltage of switch S1 rises, hence the base voltage of switch S1 rises, as mentioned above. Initially, the first transistor 31 is non-conductive. The base voltage of the first transistor 31 follows the emitter voltage of the first transistor 31, which is equal to the base voltage of switch S1. When the base voltage of switch S1 reaches the breakdown voltage of the Zener diode 24 plus the forward voltage of the diode 34, the Zener diode 24 will breakdown and draw a current in the first transistor 31 so that this first transistor 31 makes a transition to its conductive state. As a consequence, the base voltage of the switch S1 is pulled down and the switch S1 is turned off. Further, the voltage drop over the fifth resistor 32 rises and the second transistor 33 becomes conductive, shorting the Zener diode and accelerating the switching off of the switch S1 and the discharging of the auxiliary capacitor 26.

An advantage of the control device 30 is that it achieves a faster switch off of the switch S1. Consequently, the delay between the moment when the voltage across sensing resistor 21 reaches the switch-off value as determined by the Zener diode 24 on the one hand, and the moment when the switch S1 actually becomes non-conductive, is reduced, so the switching timing is more accurately related to the current detection and the regulation is better.

As already mentioned earlier, during the second stage, the current in the first inductor L1 decreases and also the current in the second inductor L2 reduces. At a certain moment in time, these currents become zero, but this timing depends on the component values. In a preferred embodiment, the inductance value of the first inductor L1 and the inductance value of the second inductor L2 are chosen such that the reducing current in the first inductor L1 always reaches zero before the reducing current in the second inductor L2 reaches zero. C1 value is big enough to ensure it's only the function of transfer energy from L1 to LED Load, so the target is to design L1 and L2 value ensure L1 always works on discontinuous mode. As for L1 and L2 relationship, it depends on input voltage(terminal 5 and 6) and output voltage(terminal 9*a* and 9*b*). so it isn't simple to say L1<L2.

Figure 4A:
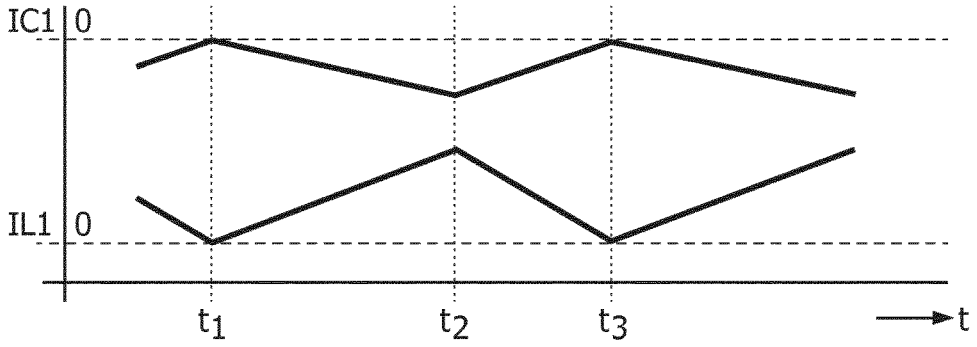
FIG. 4A is a graph illustrating current waveforms in the converter.

As explained in the above, controlling the switching from conductive state to non-conductive state of the switch S1 is based on the sum of the charge current in first inductor L1 and discharge current of storage capacitor C1. Switching the switch S1 to its conductive state is based on the output current in the second diode D2 reaching zero. As a result, the current IL1 in first inductor L1 and the current IC1 in storage capacitor C1 have complementary wave-form envelopes. FIG. 4A is a graph showing these currents (vertical axis in arbitrary units) as a function of time (horizontal axis in arbitrary units) obtained in an experimental embodiment of the driver. The direction from D1 to L1 to C1 to L2 is taken as positive direction, therefore IC1 is shown as being negative. The graph shows that, during the first state from t1 to t2 when the switch S1 is conductive, the magnitude of IL1 rises from a lowest value which may be higher than zero to a highest value, L1 values will be designed to ensure IL1 rises from zero to highest values, whereas the magnitude (i.e. absolute value) of IC1 rises from a lowest value which may be higher than zero to a highest value. During the second state from t2 to t3 when the switch S1 is non-conductive, IL1 and IC1 decrease to their respective lowest values. Since at time t2 the sum of IL1 and IC1 will always have the same value, the highest discharge current of storage capacitor C1 will always decrease when the highest charge current in first inductor L1 increases and vice versa.

Figure 4B:
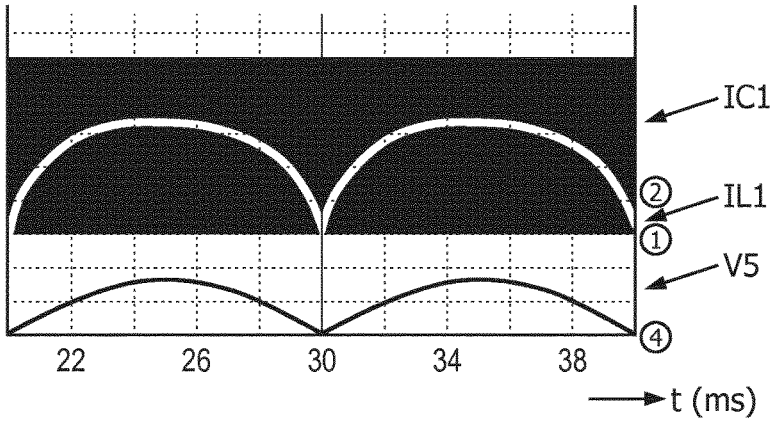
FIG. 4B is a graph comparable to FIG. 4A but on a larger time scale.
Figure 4C:
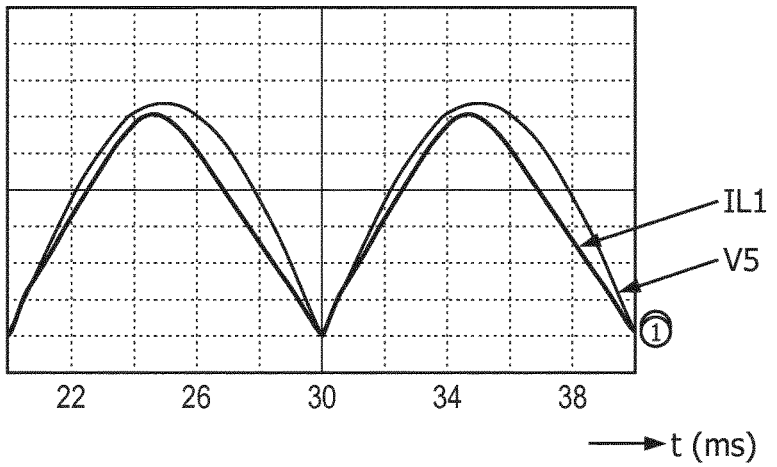
FIG. 4C is a graph illustrating current waveform envelope in the converter.
Figure 4D:
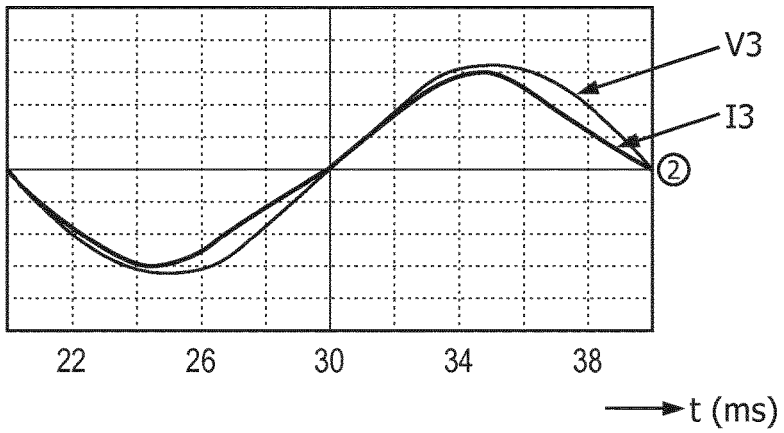
FIG. 4D is a graph illustrating input voltage and current waveform for the converter.

FIG. 4B shows the same currents at a larger time scale, covering a full period of the mains. FIG. 4B also shows the waveform of rectified mains voltage V5, in arbitrary units. The figure clearly shows the complementary wave-form envelopes of the currents. Further, the figure clearly shows that the wave-form envelope of IL1, i.e. the line current, follows the rectified mains voltage V5, and is in phase therewith, which is good for power factor correction. FIG. 4C shows the wave-form envelope of IL1, obtained by measuring IL1 via a low-pass filter, together with the rectified mains voltage V5, and FIG. 4D shows the input voltage V3 and input current I3 measured at the input of the rectifier 3, which was implemented as a Graetz bridge. The total harmonic distortion was found to be around 8% and the power factor was found to be about 99%. It is noted that this near-perfect current shaping is obtained without any modulation of the output-current set-point.

Figure 5:
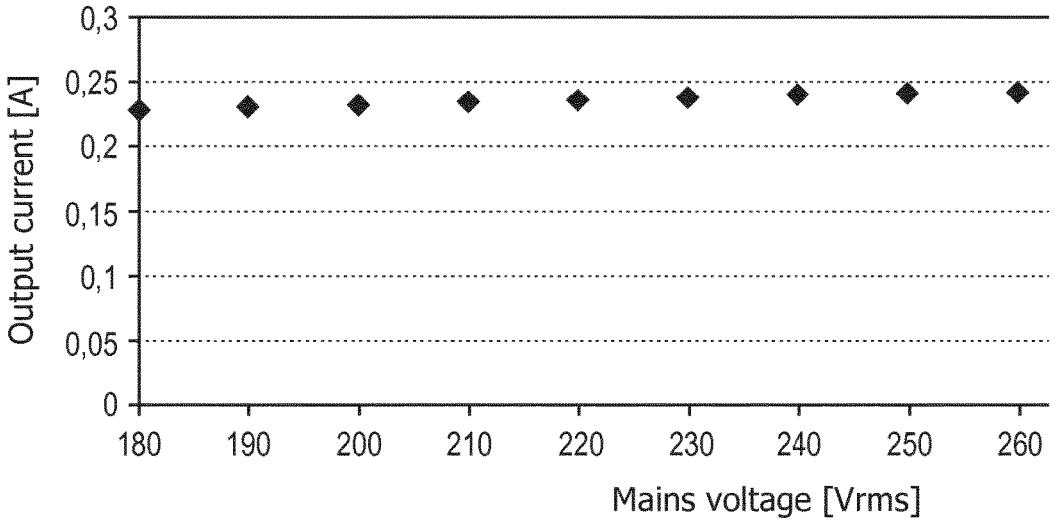
FIG. 5 is a graph illustrating measured output current as a function of the supply voltage for an experimental specimen of the converter according to FIG. 2.

In an experiment with variable AC supply replacing the mains, the supply voltage was varied and the output current in the load L was measured. FIG. 5 shows the measured output current (vertical axis) as a function of the supply voltage (horizontal axis). It can be seen that the output current is substantially constant over a large range of supply voltage values. The slight dependency of the output current on the input voltage was found to be due to a non-ideal behaviour of the current detector/comparator in the experimental specimen.

Figure 6A:
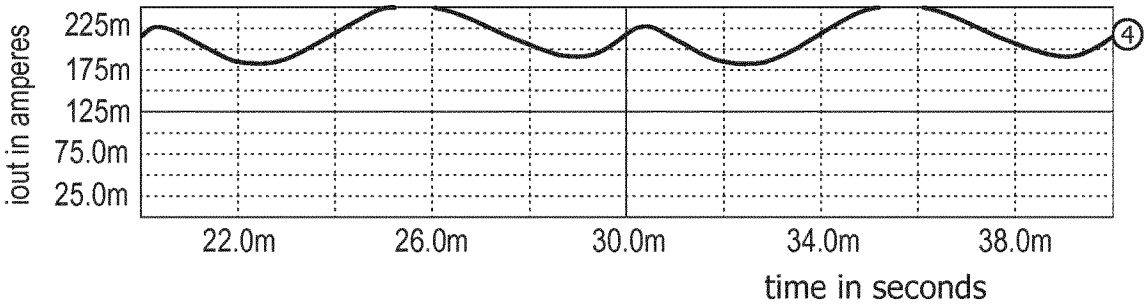
FIG. 6A is a graph illustrating measured output current as a function of time for an experimental specimen of the converter according to FIG. 2.
Figure 6B:
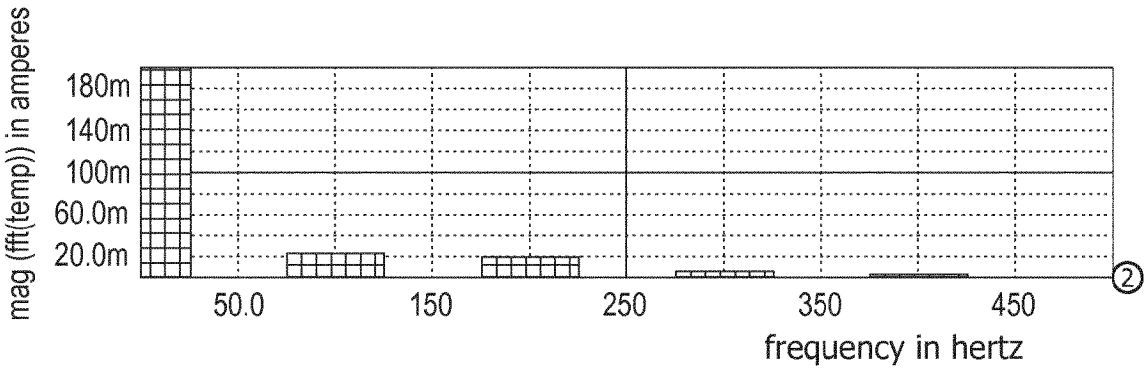
FIG. 6B is a graph illustrating measured frequency content for this experimental specimen of the converter according to FIG. 2.

The sum-of-currents control method increases the current through second inductor L2/L3 around the zero-crossings of the mains (see FIG. 4B). This gives a rise in output current around the zero-crossings and introduces frequency doubling of the output ripple which is beneficial because flicker and stroboscopic effects become less apparent when the frequency increases. FIGS. 6A and 6B are graphs showing the output current in the time domain and frequency domain, respectively, obtained in a test circuit according to FIG. 2. The ratio between peak and average ripple is approximately 18%. The 100 Hz component of the ripple is approximately 10% of the DC value and the 200 Hz component is also around 10% of the DC value.

Summarizing, the present invention provides a driver comprising:

a first diode and a first inductor connected in series between a first input terminal and a first node;

a first capacitor and a second inductor connected in series between a second input terminal and the first node;

a switch connected between the first node and the second input terminal;

a capacitor connected between output terminals;

a second diode connected in series with said capacitor.

The series arrangement of second diode and capacitor is connected in parallel with said second inductor, or in parallel with a third inductor inductively coupled to said second inductor.

Said switch is controlled to a non-conductive state when the current through said switch is equal to or higher than a threshold.

Said switch is controlled to a conductive state when the current through said second diode reaches zero.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, instead of connecting the sensed voltage of sensing resistor 21 and the reference voltage of zener diode 24 to the emitter and base terminals, respectively, of the switch transistor S1, it is also possible to apply these voltage to respective input terminals of a comparator and to drive the switch transistor S1 on the basis of an output signal from such comparator.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. Even if certain features are recited in different dependent claims, the present invention also relates to an embodiment comprising these features in common. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

What is claimed is:

1. Driver for driving a load, the driver having BiFRED topology and comprising:

a first input terminal and a second input terminal;

a pair of output terminals for connecting the load;

a BiFRED converter coupled to the input terminals, comprising a first inductor, coupled to a first input terminal;

a first capacitor in series connection with the first inductor;

a controllable switch between the interconnection of the first inductor and the first capacitor and the second input terminal;

a second inductor coupled between the first capacitor and the second input terminal;

a control device for controlling the controllable switch;

wherein said control device comprises:

a first sensing element for sensing the current through said switch and providing a first output signal proportional to said current, said current being the sum of the charging current of the first inductor and discharging current of the first capacitor;

a reference device for providing a reference signal;

a comparing element for comparing said first output signal with said reference signal, and for switching said switch to a non-conductive state in each transition of the controllable switch's oscillation when said first output signal is equal to or higher than said reference signal;

an output capacitor connected between said output terminals a second diode connected in series with said output capacitor;

a second sensing element for sensing the current through said second diode, and for providing a second output signal for switching said controllable switch to a conductive state when said current through said second diode reaches zero;

wherein said second sensing element comprises a sensing inductor inductively coupled to said second inductor wherein the sensing inductor having one end connected to the second input terminal and having its opposite end coupled to the control terminal of the controllable switch.

2. A driver according to claim 1, wherein the BiFRED converter comprises:

a first series arrangement of a first diode and the first inductor, the first series arrangement having one end connected to the first input terminal and having an opposite second end connected to a first node;

a second series arrangement of the first capacitor and the second inductor, the second series arrangement having one end connected to the second input terminal and having an opposite second end connected to the first node;

the controllable switch connected between the first node and the second input terminal wherein when the switch is conductive the first inductor is charged by the input terminals and the first capacitor discharges to charge the second inductor, and when the switch is non-conductive the first inductor discharges to charge the first capacitor, and said switch is adapted to oscillate for converting power;

wherein the series arrangement of second diode and output capacitor is connected in parallel with said second inductor, or in parallel with a third inductor inductively coupled to said second inductor.

3. Driver according to claim 2, wherein said first inductor has an inductivity selected such that, in the non-conductive state of said switch the current in said first inductor reaches zero before the second sensing element switches said switch to the conductive state.

4. Driver according to claim 1, wherein said first sensing element comprises a sensing resistor connected between the switch and the second input terminal.

5. Driver according to claim 1, wherein said reference device comprises a Zener diode.

6. Driver according to claim 1, wherein said controllable switch comprises a transistor or a FET, having a first current path terminal coupled to said node, having a second current path terminal coupled to the second input terminal via a sensing resistor, and having a control terminal.

7. Driver according to claim 6, wherein said reference device comprises a Zener diode having an anode coupled to the second input terminal and having a cathode coupled to the control terminal of the controllable switch.

8. Driver according to claim 7, further comprising a switch-off accelerator circuit connected between said Zener diode and the control terminal of the controllable switch.

9. Driver according to claim 8, wherein the switch-off accelerator circuit comprises a second switch having one current path terminal connected to the control terminal of the controllable switch, having a second current path terminal coupled to the second input terminal via a second sensing resistor, and having a control terminal coupled to the cathode of said Zener diode via a third diode.

10. Driver according to claim 9, wherein the switch-off accelerator circuit comprises a third switch having one current path terminal connected to the control terminal of the second switch, having a second current path terminal connected to the second input terminal, and having a control terminal connected to the second current path terminal of the second switch.

11. Driver according to claim 6, wherein the sensing inductor having the opposite end coupled to the control terminal of the controllable switch via a series arrangement of a capacitor and a resistor.

12. Driver according to claim 11, further comprising a diode connected in parallel to said capacitor.

13. Driver according to claim 1, wherein the load comprises at least one LED.

14. Driver according to claim 1, further comprising a rectifier and an EMI filter.

* * * * *